US010533419B2

(12) United States Patent
Braxmaier et al.

(10) Patent No.: US 10,533,419 B2
(45) Date of Patent: Jan. 14, 2020

(54) PUMP DEVICE WITH PUMP RING HAVING CURVED CONTACT PORTION

(71) Applicant: EBM-PAPST ST. GEORGEN GMBH & CO. KG, St. Georgen (DE)

(72) Inventors: Markus Braxmaier, Vs-Schwenningen (DE); Daniel Hauer, Ortenberg (DE); Hassan Ghodsi-Khameneh, Offenburg (DE); Juergen Herr, St. Georgen (DE); Marc Jeuck, Buehl/Baden (DE); Wolfgang Laufer, Aichhalden (DE); Mario Staiger, Scramberg-Tennenbronn (DE)

(73) Assignee: ebm-papst St. Georgen GmbH & Co. KG, St. Georgen (DE)

( * ) Notice: Subject to any disclaimer, the term of this patent is extended or adjusted under 35 U.S.C. 154(b) by 216 days.

(21) Appl. No.: 15/557,124

(22) PCT Filed: Mar. 31, 2016

(86) PCT No.: PCT/EP2016/057157
§ 371 (c)(1),
(2) Date: Sep. 10, 2017

(87) PCT Pub. No.: WO2016/173800
PCT Pub. Date: Nov. 3, 2016

(65) Prior Publication Data

US 2018/0045049 A1 Feb. 15, 2018

(30) Foreign Application Priority Data

Apr. 29, 2015 (DE) ..... 10 2015 106 612

(51) Int. Cl.
*F03C 2/00* (2006.01)
*F03C 4/00* (2006.01)
(Continued)

(52) U.S. Cl.
CPC ..... *F01C 5/02* (2013.01); *F04C 5/00* (2013.01); *F04C 2240/30* (2013.01)

(58) Field of Classification Search
CPC ..... F01C 5/02; F01C 21/0845; F04C 5/00; F04C 2240/30; F05C 2225/00
(Continued)

(56) References Cited

U.S. PATENT DOCUMENTS 3,408,947 A * 11/1968 McMillan ..... F04C 5/00 418/45
4,332,534 A 6/1982 Becker ..... 418/45
(Continued)

FOREIGN PATENT DOCUMENTS

DE 10-2011-015110 2/2012 ..... F04D 15/00
DE 10-2013-104245 A 10/2014 ..... F04C 5/00
(Continued)

*Primary Examiner* — Theresa Trieu
(74) *Attorney, Agent, or Firm* — Dickinson Wright PLLC

(57) ABSTRACT

A pump device for pumping a liquid, has a hydraulics housing (12), in which a pump ring (14) with a contact surface (46), a pump ring support (16) and an eccentric (18), which can be driven by a shaft (20), are accommodated. The hydraulics housing (12) has an annular portion (22) and a first and a second lateral section (24, 26), the two lateral sections (24, 26) being arranged opposite each other. The pump ring (14) is mounted between the two lateral sections (24, 26) of the hydraulics housing (12) at least in some portions. The profile of the contact surface (46) has a contour with a curvature that changes at least in portions, and specifically in such a way that the curvature increases at least in some portions towards the ends of the contact surface (46).

9 Claims, 4 Drawing Sheets

(51) Int. Cl.

| | |
|---|---|
| ***F04C 2/00*** | (2006.01) |
| ***F04C 18/00*** | (2006.01) |
| ***F01C 5/02*** | (2006.01) |
| ***F04C 5/00*** | (2006.01) |

(58) Field of Classification Search
USPC ..... 418/54, 126–128, 152–153, 156
See application file for complete search history.

(56) References Cited

U.S. PATENT DOCUMENTS

| | | | | |
|---|---|---|---|---|
| 9,453,507 | B2 | 9/2016 | Ghodsi-Kameneh | |
| 9,752,484 | B2 | 9/2017 | Brueck et al. | F01N 3/28 |
| 2014/0017094 | A1 | 1/2014 | Ghodsi-Kameneh | 417/44.1 |
| 2017/0144692 | A1 | 4/2017 | Hodgson et al. | F01N 3/20 |

FOREIGN PATENT DOCUMENTS

| | | | | |
|---|---|---|---|---|
| GB | 583578 | A | 11/1944 | |
| WO | 2014-173789 | A | 10/2014 | F01N 3/20 |
| WO | 2012-126544 | A | 9/2015 | F04B 13/00 |

* cited by examiner

PUMP DEVICE WITH PUMP RING HAVING CURVED CONTACT PORTION

BACKGROUND

1. Field

The invention relates to a pump device for pumping a fluid.

2. Description of Related Art

A pump device or pump is understood here to mean a machine which serves to transport fluids. These also include fluid-solid mixtures, pastes and fluids with a slight gas content. During operation of the pump device, the work of the drive is converted into the kinetic energy of the transported fluid.

The illustrated pump device is also referred to as an orbital pump, rotary diaphragm pump or peristaltic pump.

The pump device can be used to transport a fluid from a reservoir, for example a tank, into a desired environment, for example into an exhaust system of an internal combustion engine.

Known from the publication DE 10 2013 104 245 A1 is a pump device which is configured as an orbital pump which has a pump housing with at least one inlet and at least one outlet, wherein an eccentric is arranged on the pump housing so as to be rotatable relative to the pump housing. An electric drive is provided in order to move the eccentric. Arranged between the eccentric and the pump housing is a deformable diaphragm which, together with the pump housing, delimits a delivery path from the at least one inlet to the at least one outlet and forms at least one seal of the delivery path. The at least one seal is displaceable, through a movement of the eccentric, in order to deliver the fluid along the delivery path.

The publication WO 2012/126544 A1 describes a metering system for metering a liquid with a pump device which is equipped with an eccentric drive which can be driven by an electric motor. The pump device, which has two delivery directions, has a pump ring and a stationary ring which is arranged relative to the pump ring and to the eccentric drive in such a way that a pump chamber is formed between the stationary ring and the pump ring which changes shape upon rotation of the electric motor in order to deliver a liquid to be metered through the pump chamber. The functional principle of an orbital pump is described in this publication.

SUMMARY

Against this background, a pump device with the features of claim 1 is presented. Embodiments thereof are disclosed in the dependent claims and in the description.

A pump device for pumping a fluid is presented herein, comprising a hydraulics housing within which a pump ring with a contact surface, a pump ring support and an eccentric are accommodated. Said eccentric is driven by a shaft, which is in turn typically driven by a controllable drive, for example an electric motor. The shaft also defines an axial direction and a radial direction. The eccentric is configured to be rotatable relative to the hydraulics housing and is arranged such that, depending on the rotational position of the eccentric, it presses the pump ring unevenly, at least in certain regions, against the hydraulics housing. The pump ring, which is also referred to as a diaphragm, is thereby deformable and defines, at least in certain regions, a pump chamber, for example an annular pump chamber. A first connection and a second connection are also typically provided which are, in each case, in fluid communication with the pump chamber.

The hydraulics housing comprises an annular portion and a first and second lateral section, wherein the two lateral sections are arranged opposite one another, and wherein the pump ring is arranged, at least in certain portions, between the two lateral sections of the hydraulics housing.

A contact surface of the pump ring, i.e. the surface of the pump ring with which it is pressed against the hydraulics housing, in particular the annular portion of the hydraulics housing, and through which the fluid is moved along the contact surface and runs along this, has a profile which has a contour with a curvature that changes, at least in portions, and specifically in such a way that the curvature increases, at least in some portions, towards the ends of the contact surface. The contact surface of the pump ring can also be described as a delivery chamber surface of the pump ring.

The contour described leads to a reduction in flatness in the contact surface of the pump ring and achieves linearization of the distribution of pressure on the contact surface. Different configurations of the contour can be chosen. For example, beginning from the center of the contact surface, it is possible to start with a large radius and reduce this, continuously or in steps, towards the ends.

In one embodiment, the pump ring comprises a base from which two first projections extend on a side facing away from the pump ring support and two second projections extend on a side facing the pump ring support, wherein the contact surface is limited by side walls of the first projections. This makes possible a stable structure of the pump ring and the pump.

In a further embodiment, at least one of the first and second projections comprises a first section and a second section, wherein the first section connects the second section with the base, wherein the first section extends to a greater extent in a radial direction than in an axial direction and the second section extends to a greater extent in an axial direction than in a radial direction. It can be the case that only one of the first and second projections, two of the first and second projections, three of the first and second projections or all of the first and second projections are configured in this way.

It can be the case that the second projections in each case enclose an angle of 25° to 90° with the base of the pump ring in the region of a transition to the base. This guarantees a secure connection between pump ring support and pump ring. The two components can also be adhesively bonded with one another, for example by means of a primer.

It can also be the case that the profile of the contact surface has a central region, in an axial direction, without curvature.

In yet a further embodiment, the ratio between the width of the contact surface and the thickness of the pump ring between the contact surface and the pump ring support is between 1.5 and 5.0, preferably between 1.5 and 3.5. This has proved advantageous for the function of the pump device, in particular in terms of achieving a good build-up of pressure by means of the pump ring.

The coverage of the pump ring laterally to the pump ring support can also amount to more than 0.9 mm, for example 1.0 mm. Coverage is understood here to refer to the material thickness of the pump ring in the aforementioned region.

The pump ring is typically made of a deformable material. Suitable for this purpose is for example an elastomeric material which guarantees a lasting deformability. Elastomeric materials are available in different degrees of hardness, so that a functionally optimal structure of the pump device can be implemented. In one embodiment, the Shore hardness of the pump ring lies between 55 and 70 Shore.

In addition, the pump ring can be made of a material with a glass transition temperature below −20° C. This makes it possible to use the pump device in a wide range of temperatures without the material becoming brittle. In particular, the start-up behavior at low and even negative temperatures is improved.

The pump device presented has, at least in some of the embodiments, advantages in comparison with known pump devices. For example, a high leak tightness is achieved, which makes possible a rapid and high pressure build-up. The structure also serves to increase the service life.

Further advantages and variants of the invention are disclosed in the description and the enclosed drawing.

It should be understood that the aforementioned features and those which will be explained in the following can be used, not only in the combination stated in each case, but also in other combinations, or on their own, without departing from the scope of the present invention.

BRIEF DESCRIPTION OF THE DRAWINGS

The invention is represented schematically in the drawings with reference to various embodiments and will be described schematically and in detail with reference to the drawings, wherein.

DETAILED DESCRIPTION

Figure 1:
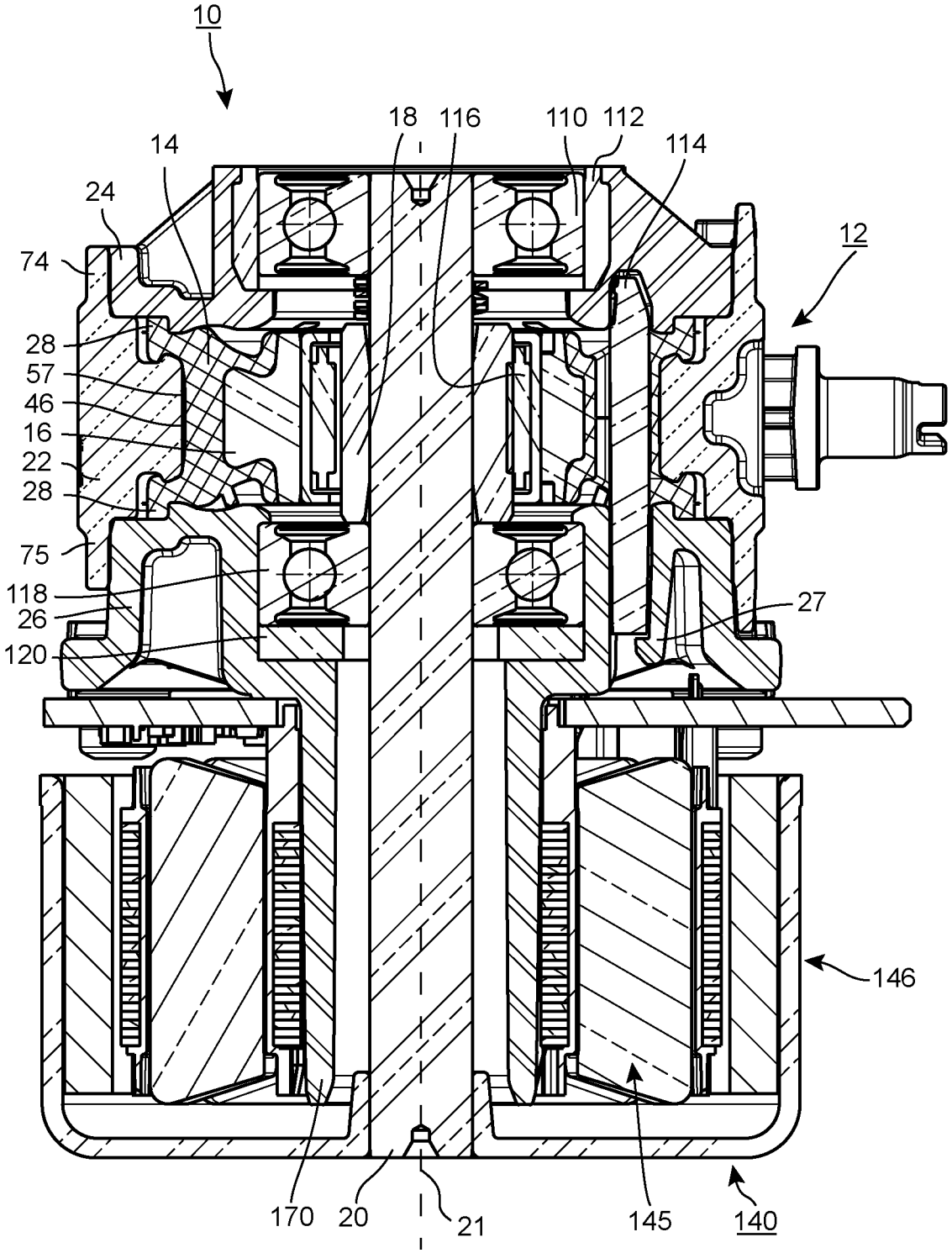
FIG. 1 shows a sectional view of an embodiment of the described pump device.

FIG. 1 shows a sectional view of an embodiment of the described pump device, which is identified as a whole with the reference number 10 and is implemented as an orbital pump. The illustration shows a hydraulics housing 12, a pump ring 14, a pump ring support 16, an eccentric 18, a shaft 20, a drive 140, a first bearing 110, a second bearing 118, a bushing or socket 112, which can also be described as a ring 112, a clamping element 114, which can also be described as a separating chamber pin, an eccentric bearing 116, and a sealing ring 120, which can also be described as a gasket 120.

In this embodiment, the first bearing 110 is installed as a floating bearing, and the second bearing 118 as a fixed bearing. This provides a good mounting.

A needle bearing can be used as the eccentric bearing 116. This has a short extent in a radial direction. Other bearing types, for example roller bearings, are also possible. The eccentric bearing 116 makes possible a low-friction transmission of forces between the rotating eccentric 18 and the rotationally-fixed pump ring 14 or pump ring support 16.

The hydraulics housing 12 comprises an annular portion 22 and a first lateral section 24, which can also be described as a pump cover, and a second lateral section 26, which can also be described as a motor flange or drive flange. The two lateral sections 24, 26 are arranged opposite one another. The pump ring 14 thereby lies, at least in portions thereof, between the two lateral sections 24, 26 of the hydraulics housing 12. The annular portion 22 has a first collar 74 and a second collar 75.

The drive 140 has a stator arrangement 145 and a rotor arrangement 146. The drive 140 is partially attached to a tubular region 170 of the second lateral section 26.

The pump housing 12 has a snap-locking element 27, which is designed to snap into engagement, upon introduction of the clamping element 114 into the pump housing 12 and to secure the clamping element 114 axially. The introduction of the clamping element 114 can take place before the installation of the drive 140.

The pump ring 14 is deformable and can be made of an elastomeric material or another deformable material.

Figure 2:
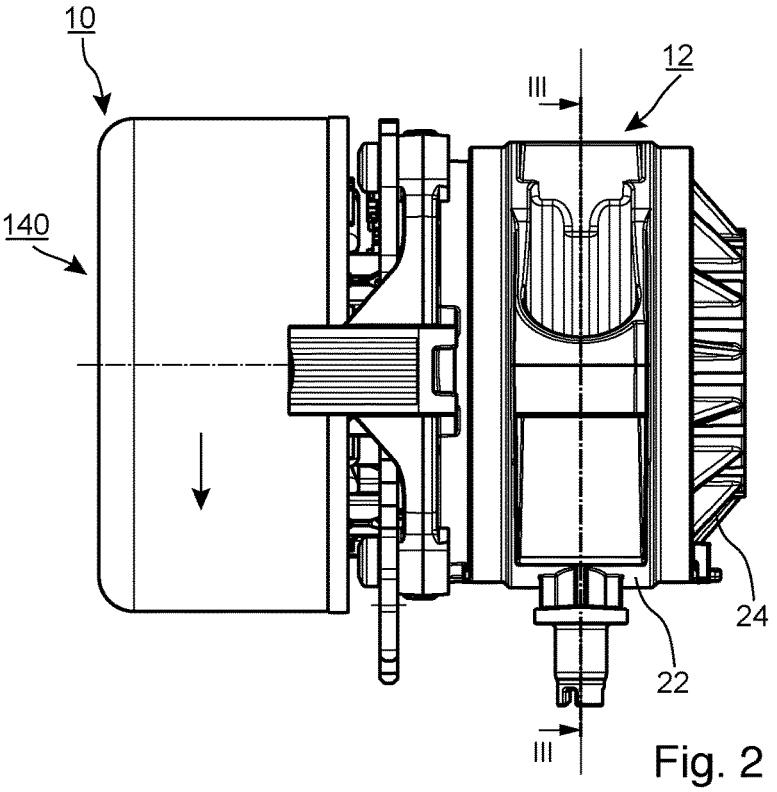
FIG. 2 shows a side view of the pump device from FIG. 1.

FIG. 2 shows a side view of the pump device 10 shown in FIG. 1.

Figure 3:
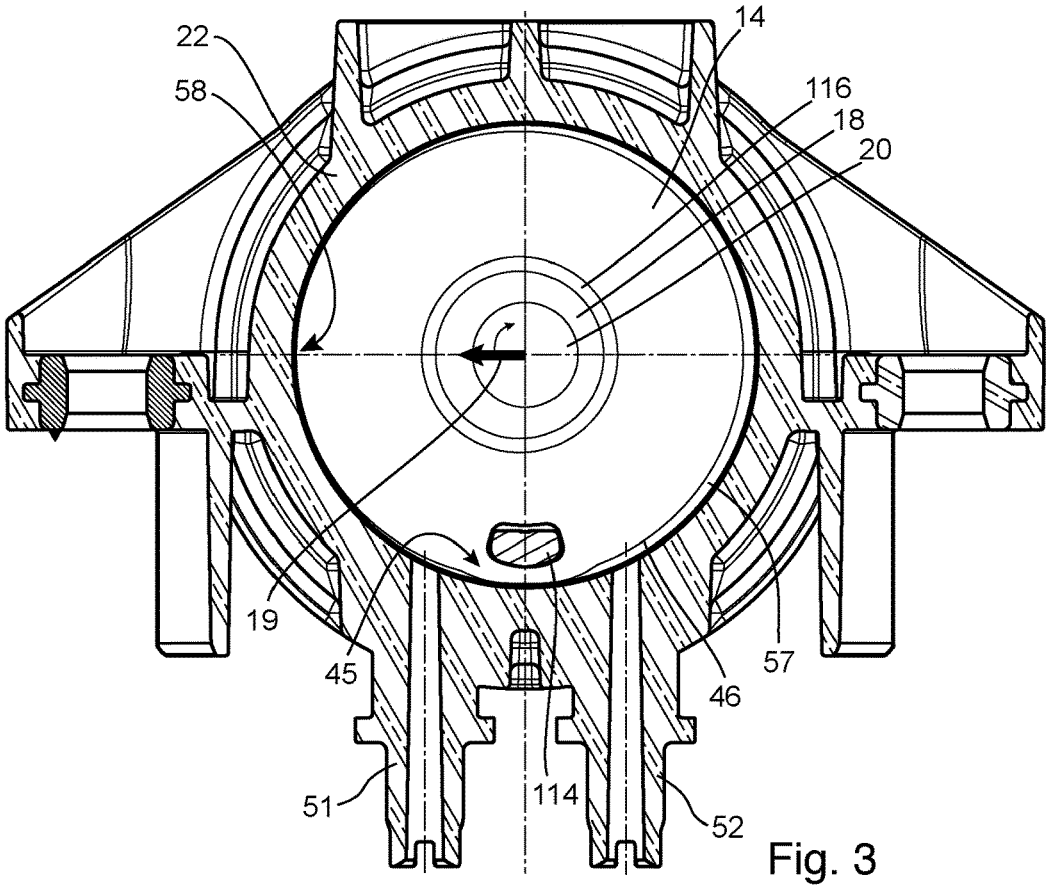
FIG. 3 shows a sectional view of the pump device from FIG. 1.

FIG. 3 shows a cross section through the pump device 10, viewed along the section line III-III shown in FIG. 2. A first connection 51 and a second connection 52 are provided, and these connections 51, 52 are in fluid communication with a pump chamber 57 which is formed between the annular portion 22 of the hydraulics housing and a contact surface 46 of the pump ring and in the illustration shown in FIG. 3 extends in an annular manner from the first connection 51 in a clockwise direction up to the second connection 52. In the section which extends from the first connection 51 in an anticlockwise direction up to the second connection 52, the pump chamber 57 is deactivated through the clamping element 114 in that the clamping element 114 presses the contact surface 46 of the pump ring 14 statically against the annular portion 22 of the hydraulics housing 12, thus preventing or at least greatly reducing a fluid flow through this section. The region in which the clamping element 114 presses the contact surface 46 of the pump ring 14 against the annular portion 22 is also referred to in the following as the "clamping element region" 45.

The illustration depicts the interior of the hydraulics housing 12 schematically and in an exaggerated manner, in terms of the deformation of the pump ring 14, in order to explain the principle.

The functional principle of the orbital pump is described in the following with reference to FIG. 1 and FIG. 3.

The eccentric 18 sits on the shaft 20 and is driven by this. The drive 140, typically a motor or electric motor, serves in turn to drive the shaft 20. According to one embodiment, a controllable drive 140 is provided as a drive 140.

The shaft 20 is thereby rotated about its longitudinal axis 21, which defines an axial direction of the pump device 10. The eccentric 18 is thus also moved about the longitudinal axis of the shaft 20 in a rotational movement. This movement of the eccentric 18 is transmitted via the bearing 116 and via the pump ring support 16 to the pump ring 14. The pump ring support 16 and the pump ring 14 are rotationally fixed relative to the hydraulics housing 12, but depending on the rotational position of the eccentric 18 they are moved locally closer to or further away from the annular portion 22. In FIG. 3, the eccentric 18 points in a direction indicated with an arrow 19, pointing to nine o'clock in the example illustrated, i.e. the region of the eccentric 18 with the greatest radial extent or dimension points in the direction of the arrow 19. This causes the pump ring 14 to be moved in this direction 19 and pressed against the annular portion 22 in the region 58. As a result, the pump channel 57 is narrowed or completely blocked in the region 58.

If the eccentric now rotates in a clockwise direction, the point 58 at which the pump ring 14 is pressed against the annular portion 22 also travels along in a clockwise direction, and, as a result, the fluid in the pump chamber 57 is pumped or transported in a clockwise direction from the first connection 51, to the second connection 52. A hydraulic short circuit, in which the fluid passes from the second connection 52 in a clockwise direction to the first connection 51, is prevented due to the clamping element 114 or another interruption of the pump chamber 57 in this region.

The pump device 10 also functions in the reverse direction, in that the direction of rotation of the eccentric 18 is reversed.

Figure 4:
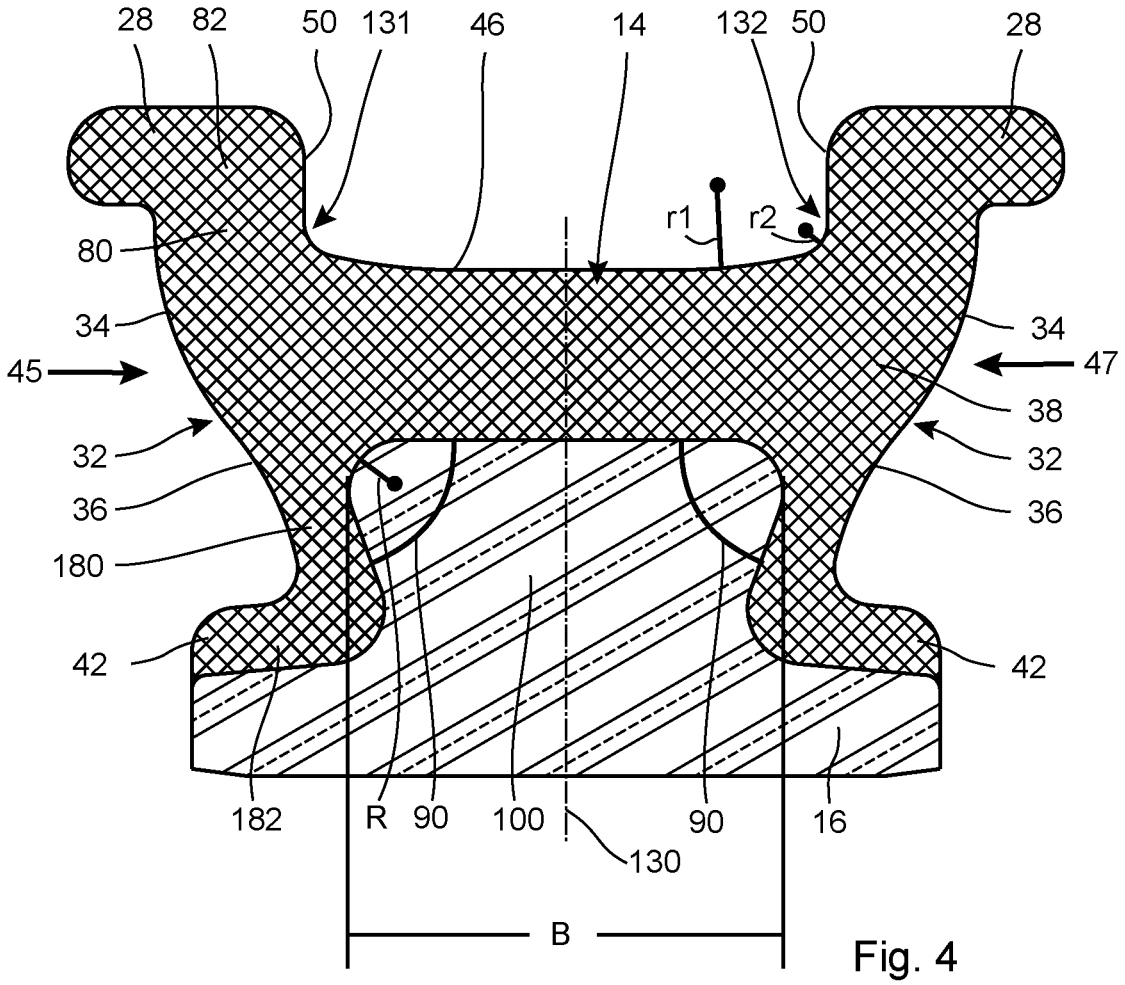
FIG. 4 shows a sectional view of an embodiment of the pump ring.

FIG. 4 shows a sectional view of the pump ring 14 from FIG. 1. The profile of the pump ring 14 and of the pump ring support 16 can be seen, and the sectional view corresponds to a longitudinal section through the pump device 10.

The pump ring 14 is connected with the pump ring support 16, for example by means of adhesive bonding. The contact surface 46 of the pump ring 14 is provided on the side of the pump ring 14 facing away from the pump ring support. This contact surface 46 is, in the pump chamber 57, pressed against the annular portion 22 or pulled away therefrom, depending on the rotational position and rotational movement of the eccentric 18.

It can be seen that the contour of the contact surface 46 has a curvature that changes, at least in portions, wherein, beginning from a center 130 of the contact surface 46, the curvature increases towards the two ends 131, 132. This means that the radius of the curvature is reduced towards the ends. By way of example, a first radius r1 and a second radius r2 are indicated in the drawing, and it can be seen that the first radius r1 is greater than the second radius r2, which is closer to the end 132.

In the embodiment shown, the curve of the contour is symmetrical in relation to this center 130. However, an asymmetrical structure can also be chosen.

The pump ring 14 comprises a base 38 from which two first projections 28 extend on a side facing away from the pump ring support 16 and two second projections 42 extend on a side facing the pump ring support 16. The contact surface 46 is thereby limited by side walls 50 of the first projections 28.

The first and second projections 28, 42 in each case comprise a first section 80, 180 and a second section 82, 182, wherein the first section 80, 180 in each case connects the second section 82, 182 with the base 38. It can be seen that the first section 80, 180 extends to a greater extent in a radial direction than in an axial direction and the second section 82, 182 extends to a greater extent in an axial direction than in a radial direction. In other words, the first section 80, 180 has, at least in certain regions, a lesser axial dimension than the second section 82, 182.

The two second projections 42 in each case enclose an angle 90 of around 80° with the base 38 of the pump ring 14 in the region of the transition to the base 38. As a result, a secure connection between the pump ring 14 and the pump ring support 16 is guaranteed. A tongue 100 formed on the pump ring support 16 thereby projects into the region between the two second sections 42 of the pump ring 14.

The coverage of the pump ring support 14 laterally to the pump ring support 16, i.e. in the region of the first section 180 of the second projection 42, amounts to around 1.0 mm. This means that the depth or the thickness of the pump ring support 14 in this region is around 1.0 mm. However, other coverages or thicknesses can be chosen. A coverage of more than 0.9 mm has proved suitable.

Further, in the region of the two lateral sections 24, 26 of the hydraulics housing 12, in cross section the pump ring 14 follows an S-formed curve 32 with a convex section 34 and a concave section 36, wherein the convex section 34 lies further outwards in a radial direction of the shaft in comparison with the concave section 36.

The tongue 100 can be formed with a curvature in the region between the base 38 and the second projection 42 which, at least in portions, has a radius R.

A width of the pump ring support 16 is identified with B. The width of the pump ring support 16 is understood to mean the effective width of the region of the pump ring support 16 during compression of the pump ring 14. In the present exemplary embodiment, this is the region of the pump ring support 16 which lies against the base 38 of the pump ring 14, and the width of the pump ring support 16 corresponds to the width of the tongue 100.

Figure 5:
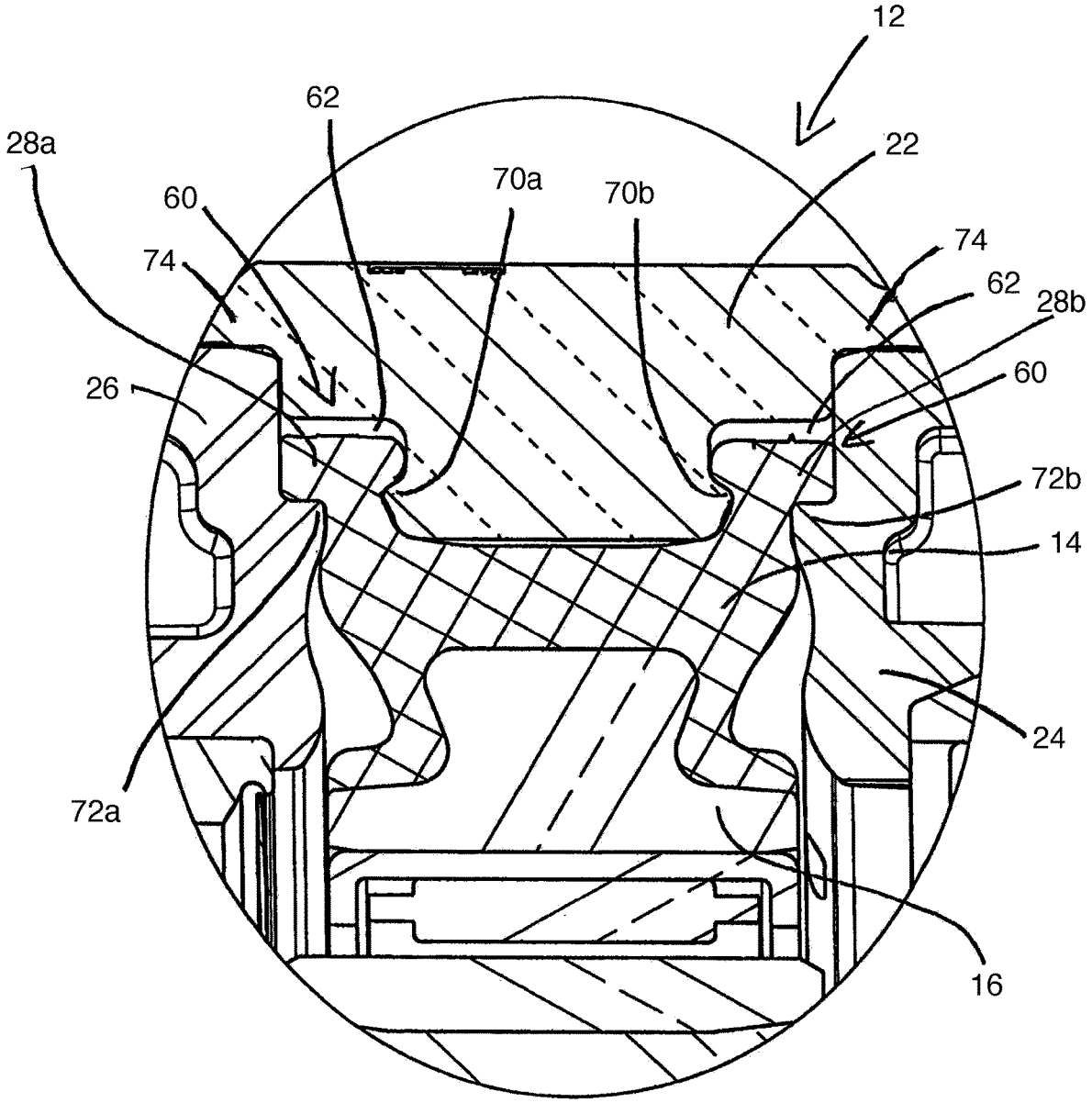
FIG. 5 shows a section from the pump device from FIG. 1.

A section from the pump device 10 of FIG. 1 is shown in FIG. 5. It can be seen from the illustration that cavities 60 are defined by the annular portion 22 and the two lateral sections 24, 26 of the hydraulics housing 12 into which cavities the first projections 28*a*, 28*b* are pressed. The left-hand first projection 28*a* is thereby in contact with the second lateral section 26 and the right-hand lateral section 28*b* is in contact with the first lateral section 24. At least one free space 62 remains in the respective cavities 60 when the first projections 28 are pressed in.

It can be seen that, on the annular portion 22 of the hydraulics housing 12, a left-hand first sealing lip 70*a* is provided in the region of the left-hand first projection 28*a* and a right-hand first sealing lip 70*b* is provided in the region of the right-hand first projection 28*b*.

The illustration also shows that a left-hand second sealing lip 72*a* is provided on the second lateral section 26 in the region of the left-hand first projection 28*a* and a right-hand second sealing lip 72*b* is provided on the first lateral section 24 in the region of the right-hand first projection 28*b*. The left-hand first sealing lip 70*a* lies at least partially opposite the left-hand second sealing lip 72*a* in an axial direction. The right-hand first sealing lip 70*b* lies at least partially opposite the right-hand second sealing lip 72*b* in an axial direction.

Naturally, a wide range of variants and modifications are possible within the scope of the present invention.

The invention claimed is:

1. A pump device for pumping a liquid, comprising a hydraulics housing (12), in which a pump ring (14) with a contact surface (46), a pump ring support (16) and an eccentric (18), driven by a shaft (20), are accommodated, said shaft defining an axial and a radial direction, wherein the hydraulics housing (12) has an annular portion (22) and a first and a second lateral section (24, 26), the two lateralsections (24, 26) being arranged opposite each other, and wherein the pump ring (14) is, at least in some portions, mounted between the two lateral sections (24, 26) of the hydraulics housing (12), wherein a profile of the contact surface (46) has a contour with a curvature that changes, at least in portions, and specifically in such a way that the curvature increases, at least in some portions, towards ends of the contact surface (46), and the pump ring (14) comprises a base (38) from which two first projections (28) extend on a side facing away from the pump ring support (16) and two second projections (42) extend on a side facing the pump ring support (16), wherein the contact surface (46) is limited by side walls (50) of the two first projections (28);

wherein the pump ring support (16) comprises a tongue (100), and the two second projections (42) define a region therebetween into which the tongue (100) projects toward the base (38) of the pump ring (14).

2. The pump device according to claim 1, wherein the first and second projections (28, 42) each comprise a first section (80, 180) and a second section (82, 182), wherein the first section (80,180) connects the second section (82, 182) with the base (38), and wherein the first section (80, 180) extends to a greater extent in a radial direction than in an axial direction and the second section (82, 182) extends to a greater extent in an axial direction than in a radial direction.

3. The pump device according to claim 1, wherein the second projections (42) enclose an angle (90) of 25° to 90° with the base (38) of the pump ring (14) in the region of the transition to the base (38).

4. The pump device according to claim 1, wherein the profile of the contact surface (46) has a central region, in an axial direction, without curvature.

5. The pump device according to claim 1, wherein a ratio between a width of the contact surface (46) and a thickness of the pump ring (14) between the contact surface (46) and the pump ring support (16) is between 1.5 and 5.0.

6. The pump device according to claim 1, wherein coverage of the pump ring (14) laterally to the pump ring support (16) amounts to more than 0.9 mm.

7. The pump device according to claim 1, wherein the pump ring (14) is made of an elastomeric material.

8. The pump device according to claim 1, wherein a Shore hardness of the pump ring (14) lies between 55 and 70 Shore.

9. The pump device according to claim 1, wherein the pump ring (14) is made of a material with a glass transition temperature below 20° C.

* * * * *